US008344664B2

(12) United States Patent
Kim et al.

(10) Patent No.: US 8,344,664 B2
(45) Date of Patent: Jan. 1, 2013

(54) POWER SAVING LIGHT EMITTING DIODE DISPLAY BOARD SYSTEM

(75) Inventors: Byung Hee Kim, Seoul (KR); Sung Sil Kim, Seoul (KR)

(73) Assignees: Daecheong Masters, Gyeonggi-Do (KR); Byung Hee Kim, Seoul (KR)

( * ) Notice: Subject to any disclaimer, the term of this patent is extended or adjusted under 35 U.S.C. 154(b) by 380 days.

(21) Appl. No.: 12/646,559

(22) Filed: Dec. 23, 2009

(65) Prior Publication Data

US 2011/0043117 A1 Feb. 24, 2011

(30) Foreign Application Priority Data

Aug. 18, 2009 (KR) ..... 10-2009-764460

(51) Int. Cl.
*H05B 37/00* (2006.01)

(52) U.S. Cl. ..... 315/312; 315/291; 315/200 R

(58) Field of Classification Search ..... 315/121, 315/123, 130, 132, 133, 192, 294, 297, 299, 315/312, 200 R, 201, 205
See application file for complete search history.

(56) References Cited

U.S. PATENT DOCUMENTS 6,127,783 A * 10/2000 Pashley et al. ..... 315/149

FOREIGN PATENT DOCUMENTS

| | | |
|---|---|---|
| JP | 2008-085324 | 4/2008 |
| JP | 2008-85324 | 4/2008 |
| KR | 10-2007-0014813 | 2/2007 |
| KR | 10-2007-0089454 | 8/2007 |
| KR | 10-2007-0014813 | 1/2009 |
| KR | 10-2007-0089454 | 3/2009 |

* cited by examiner

*Primary Examiner* — Douglas W Owens
*Assistant Examiner* — Jianzi Chen
(74) *Attorney, Agent, or Firm* — IPLA P.A.; James E. Bame

(57) ABSTRACT

In a power saving LED (Light Emitting Diode) display board system, each pixel is formed by combining at least one red LED, at least one blue LED and at least one green LED. The power saving LED display board system includes a power converter; a red LED power supply; a green LED power supply; a blue LED power supply; and a DSP (Digital Signal Processor) for controlling the red LED power supply to convert an electric power supplied from the power converter into a red LED operation power, controlling the green LED power supply to convert the electric power supplied from the power converter into a green LED operation power and controlling the blue LED power supply to convert the electric power supplied from the power converter into a blue LED operation power.

7 Claims, 8 Drawing Sheets

POWER SAVING LIGHT EMITTING DIODE DISPLAY BOARD SYSTEM

CROSS REFERENCES

Applicant claims foreign priority under Paris Convention and 35 U.S.C. §119 to Korean Patent Application No. 10-2009-764460, filed Aug. 18, 2009, with the Korean Intellectual Property Office, where the entire contents are incorporated herein by reference.

BACKGROUND OF THE INVENTION

1. Field of the Invention

The present invention relates to a power saving LED (Light Emitting Diode) display board system; and, more particularly, to a power saving LED display board system reducing energy usage for light emission of LEDs to increase energy efficiency, simplifying electric wirings therein, facilitating white-balance adjustment on the LEDs and providing stable light emission of the LEDs.

In recent, display boards employing LEDs (hereinafter, referred to as "LED display boards") are being widely used as various information transfer media, e.g., advertisement boards, public information boards and briefing boards, because they have distinctive features, from conventional display boards, in that time-varying characters and graphics can be displayed thereon. Further, since the LED display boards can show information in real time, they are being in a spotlight as information transfer media for real-time information on industrial spots or news.

In an LED display board, red, green and blue LEDs are combined to form pixels and white-balance of each pixel is adjusted to thereby express colors naturally.

In general, for white-balance adjustment, two red LEDs having relatively low color density and a green and a blue LED having relatively high color densities are combined to form a pixel.

Further, a plurality of pixels, e.g., 256 pixels, forms an LED module, and a power supply simultaneously supplies an electric power to a plurality of LED modules. An LED display board system is constructed by extending the above-described configuration according to the size of a screen.

That is, as shown in FIG. 1, a plurality of LED modules 30 receives an electric power from a power supply 20, and in case of enlarging the size of a display board, units each having a power supply 20 and a plurality of LED modules 30 are added. The power supplies 20 are connected to a common power source 10 to receive AC (Alternating Current) powers therefrom.

Further, as described above and shown in FIG. 2, each pixel has four LEDs including two red LEDs, one green LED and one blue LED. The four LEDs commonly receive an electric power of 3.5 V from a power supply, e.g., the power supply 20 of FIG. 1.

Hence, a voltage-dividing resistor R is connected to the input terminal of each red LED having a relatively low color density such that the electric power of 3.5 V is dropped to an electric power of 1.5 V and then supplied to the red LED.

However, since not only electric wirings for supplying an electric power from each power supply 20 to the LED modules 30 are complicated as shown in FIG. 1 but also much amount of electric current needs to be supplied from each power supply 20 to the LED modules 30, the above-described prior art has a drawback in that energy loss due to resistance of the wirings themselves increases.

Moreover, since an identical operating power is applied to all the LEDs of different colors by the single power supply 20 and the voltage-dividing resistors R are used for the red LEDs having relatively low color density as shown in FIG. 2, energy loss occurs at the voltage-dividing resistors R and much amount of heat is generated during the energy consumption at the voltage-dividing resistors R.

SUMMARY OF THE INVENTION

In view of the above, the present invention provides a power saving LED display board system reducing energy usage for light emission of LEDs to increase energy efficiency, simplifying electric wirings therein, facilitating white-balance adjustment on the LEDs and allowing stable light emission of the LEDs.

In accordance with one aspect of the invention, there is provided a power saving LED (Light Emitting Diode) display board system in which each pixel is formed by combining at least one red LED, at least one blue LED and at least one green LED, including:

a power converter for receiving an electric power from outside to convert the electric power;

a red LED power supply for receiving the converted electric power from the power converter to supply a red LED operation power to the red LED;

a green LED power supply for receiving the converted electric power from the power converter to supply a green LED operation power to the green LED;

a blue LED power supply for receiving the converted electric power from the power converter to supply a blue LED operation power to the blue LED; and a DSP (Digital Signal Processor) for controlling the red LED power supply to convert the electric power supplied from the power converter into the red LED operation power, controlling the green LED power supply to convert the electric power supplied from the power converter into the green LED operation power and controlling the blue LED power supply to convert the electric power supplied from the power converter into the blue LED operation power.

Preferably, each of the red LED power supply, the green LED power supply and the blue LED power supply includes a rectification circuit for supplying corresponding LED with a DC (Direct Current) power. The rectification circuit may have a rectification transistor having a frequency and a pulse width controlled by the DSP, and when conducting, a voltage smaller than a conduct voltage for a diode may be applied to the rectification transistor.

Preferably, the power converter includes an AC/DC (Alternating Current/Direct Current) converter for receiving an AC (Alternating Current) power from the outside to convert the AC power to a DC power; a DC switch for receiving the DC power from the AC/DC convertor to convert the DC power into another AC power; and a transformer for receiving said another AC power from the DC switch to transform the another AC power. While converting the AC power to the DC power, the AC/DC converter may transform a magnitude of the DC power into an appropriate magnitude as an input for a primary side of the transformer, and the DC switch may output said another AC power to the primary side of the transformer.

Preferably, the DSP has a power factor control function to control the AC/DC converter.

Preferably, the DSP has a pulse width switching modulation function to control the DC switch.

Preferably, the DSP includes a power line communications unit for performing communications with outside.

Preferably, the DSP has a white-balance function to adjust white-balance of the red LED, the green LED and the blue LED by controlling driving of the LEDs based on color temperatures of surroundings, the color temperatures being received via the power line communications unit.

Preferably, a feed-back power stabilization filter is provided at an output terminal of each of the red LED power supply, the green LED power supply and the blue LED power supply and an output terminal of the power stabilization filter is connected to an input terminal of the DSP. The DSP may observe output powers of the red LED power supply, the green LED power supply and the blue LED power supply, the output powers being received via the power stabilization filter, to control the red LED power supply, the green LED power supply and the blue LED power supply.

According to the power saving LED display board system of the present invention, energy usage for light emission of LEDs to increase energy efficiency can be reduced while electric wirings therein can be simplified. Further, white-balance adjustment on the LEDs can be facilitated and stable light emission of the LEDs can be achieved.

BRIEF DESCRIPTION OF THE DRAWINGS

The above features of the present invention will become apparent from the following description of embodiments, given in conjunction with the accompanying drawings, in which.

DETAILED DESCRIPTION OF THE EMBODIMENT

Hereinafter, embodiments of the present invention will be described in detail with reference to the accompanying drawings, which form a part hereof.

Figure 3:
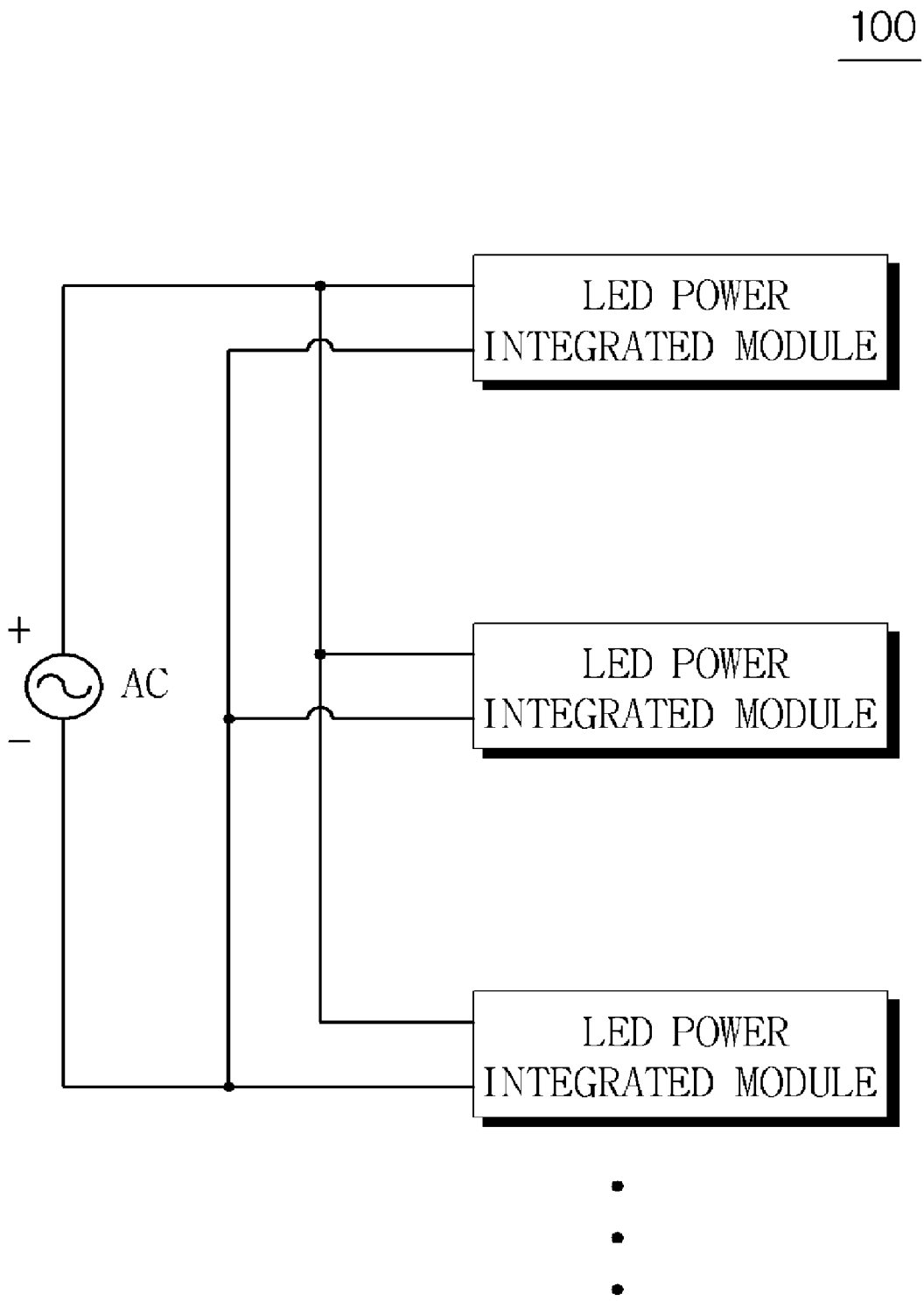
FIG. 3 illustrates a power saving LED display board system in accordance with an embodiment of the present invention.

FIG. 3 illustrates a power saving LED display board system in accordance with an embodiment of the present invention.

As shown in FIG. 3, a power saving LED display board system 100 integrates a power supply module and an LED module and controls thus integrated modules via a DSP (Digital Signal Processor), which simplifies electric wirings in the system. See the conventional LED light emission system of FIG. 1 has complicated electric wirings, because a power supply 20 and a plurality of LED modules 30 are connected to form a unit and the LED modules 30 are extended by adding thus formed units to the system.

Figure 4:
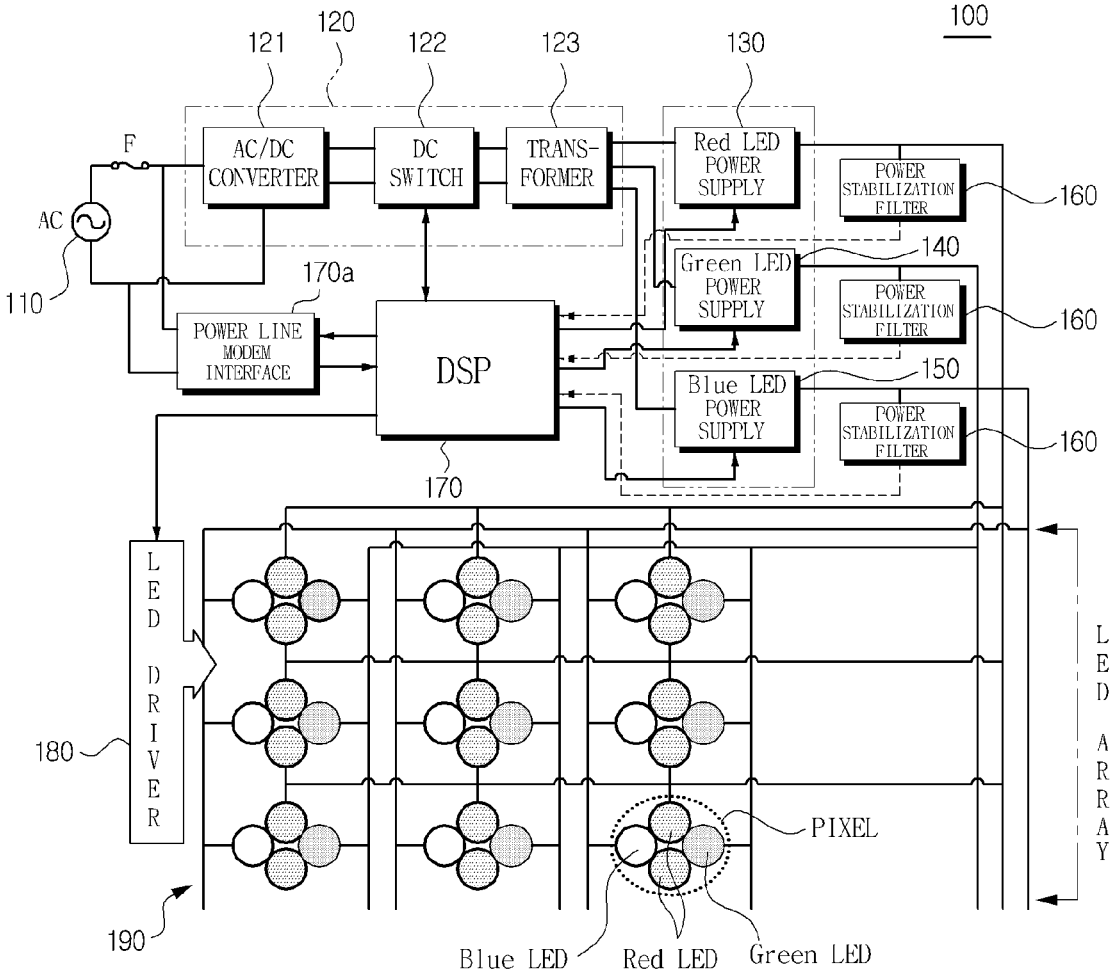
FIG. 4 illustrates a detailed view of the power saving LED display board system of FIG. 3.

FIG. 4 illustrates a detailed view of the power saving LED display board system of FIG. 3.

As shown in FIG. 4, the power saving LED disource 110 for supplying an AC power of 110 V or 220 V via a fuse F; a power converter 120 for receiving the AC power from the common power source 110 to convert the AC power into a power to be supplied to LEDs; a red LED power supply 130 for receiving the converted power from the power converter 120 to supply a red LED operation power to at least one red LED RED_LED; a green LED power supply 140 for receiving the converted power from the power converter 120 to supply a green LED operation power to at least one green LED GREEN_LED; a blue LED power supply 150 for receiving the converted power from the power converter 120 to supply a blue LED operation power to at least one blue LED BLUE_LED; a DSP (Digital Signal Processor) 170 for controlling the LED power supplies 130 to 150; and an LED array 190 which is an array of pixels, each pixel having, e.g., two red LEDs RED_LED receiving the red LED operation power from the red LED power supply 130, a green LED GREEN_LED receiving the green LED operation power from the green LED power supply 140 and a blue LED BLUE_LED receiving the blue LED operation power from the blue LED power supply 150.

Since the red LED, the green LED and the blue LED have different optimal operation powers and the red LED power supply 130, the green LED power supply 140 and the blue LED power supply 150 supply the red LED, the green LED and the blue LED with the red LED operation power, the green LED operation power and the blue LED operation power, respectively, energy consumption can be reduced.

The DSP 17 controls, based on color temperatures of the surroundings, power supplies of the red LED power supply 130, the green LED power supply 140 and the blue LED power supply 150 to adjust white-balance, thereby allowing stable white-balance adjustment and reducing energy consumption.

The power saving LED display board system 100 further includes feed-back power stabilization filters 160 disposed between output terminals of the LED power supplies 130 to 150 and an input terminal of the DSP 170, and the DSP 170 is fed-back with and observes output power status of the LED power supplies 130 to 150. Accordingly, stable optimal powers are supplied to the LEDs.

The power saving LED display board system 100 further includes software-implemented and software-controlled a power line communications unit (not shown) and a power line model interface 170*a* for performing data input and output via the power line communications unit, and thus communications with outside can be carried out.

To be specific, the common power source 110 supplying an AC power of 110 V or 220 V receives an electric power from outside and supplies the power as a driving power of the power saving LED display board system 100, and when necessary, further includes a circuit breaker, e.g., the fuse F.

The common power source 110 can be replaced with a secondary battery. In case of employing a secondary battery as the common power source 110, configuration of the power converter 120 may be changed. However, since the changes may be obvious to those skilled in the art, details thereof will be omitted.

The power converter 120 receives the AC power of 60 Hz from the common power source 110 and converts the AC power into powers for LED. The power converter 120 includes an AC/DC (Alternating Current/Direct Current) converter 121 for receiving the common AC power from the outside to convert the AC power to a DC power; a DC switch 122 for receiving the DC power from the AC/DC convertor 121 to convert the DC power into another AC power; and a transformer 123 for receiving said another AC power from the DC switch 122 to transform the another AC power. Here, while converting the AC power to the DC power, the AC/DC converter 121 transforms a magnitude of the DC power into an appropriate magnitude as an input for a primary side of the transformer 123. Further, the DC switch 122 outputs said another AC power to the primary side of the transformer 123.

Here, the AC/DC converter 121 converts the AC power of 110 V or 220 V received from the common power source 110 into a DC power having a magnitude of, e.g., about 400 V which is appropriate as an input for the primary side of the transformer 123.

Such power transformation is controlled by the DSP 170, and for this, the DSP 170 has a PFC (Power Factor Control) function to control the AC/DC converter 121.

Accordingly, the transformer 123 of the power saving LED display board system 100 can be implemented with a commercial transformer without changes, and the DSP 170 can software-control the common AC power regardless whether the common AC power is 110 V or 220 V to supply the transformer 123 with an input power where the transformer 123 has a maximum efficiency.

The DC switch 122 converts the DC power received from the AC/DC converter 121 into an AC power appropriate as an input for the primary side of the transformer 123. The DC switch 122 has therein a switching transistor (not shown), e.g., an FET (Field Effect Transistor), and generates the AC power via on-and-offs of the switching transistor synchronized to specific frequencies.

Such switching is also controlled by the DSP 170, and for this, the DSP 170 has a PWM (Pulse Width Modulation) function to control the DC switch 122.

Accordingly, the DSP can flexibly software-control the input power of the transformer 123 to be a power where the transformer 123 has a maximum efficiency.

As well known, the transformer 123 is formed with a primary side coil serving as an input side and a secondary side coil serving as an output side. The primary side of the transformer 123 is connected to an output terminal of the DC switch 122 and the secondary side of the transformer 123 is connected to the LED power supplies 130 to 150.

The red LED power supply 130, the green LED power supply 140 and the blue LED power supply 150 supply operation powers respectively to the red LEDs RED_LED, the green LED GREEN_LED and the blue LED BLUE_LED having different operation powers.

Considering differences in color densities between the LEDs, a pixel is formed with two red LEDs, one green LED and one blue LED. The red LEDs having a relatively low color density emit lights at an operation power of 1.5 V, and the green and the blue LED emit lights at an operation power of 3.8 V.

Figure 5:
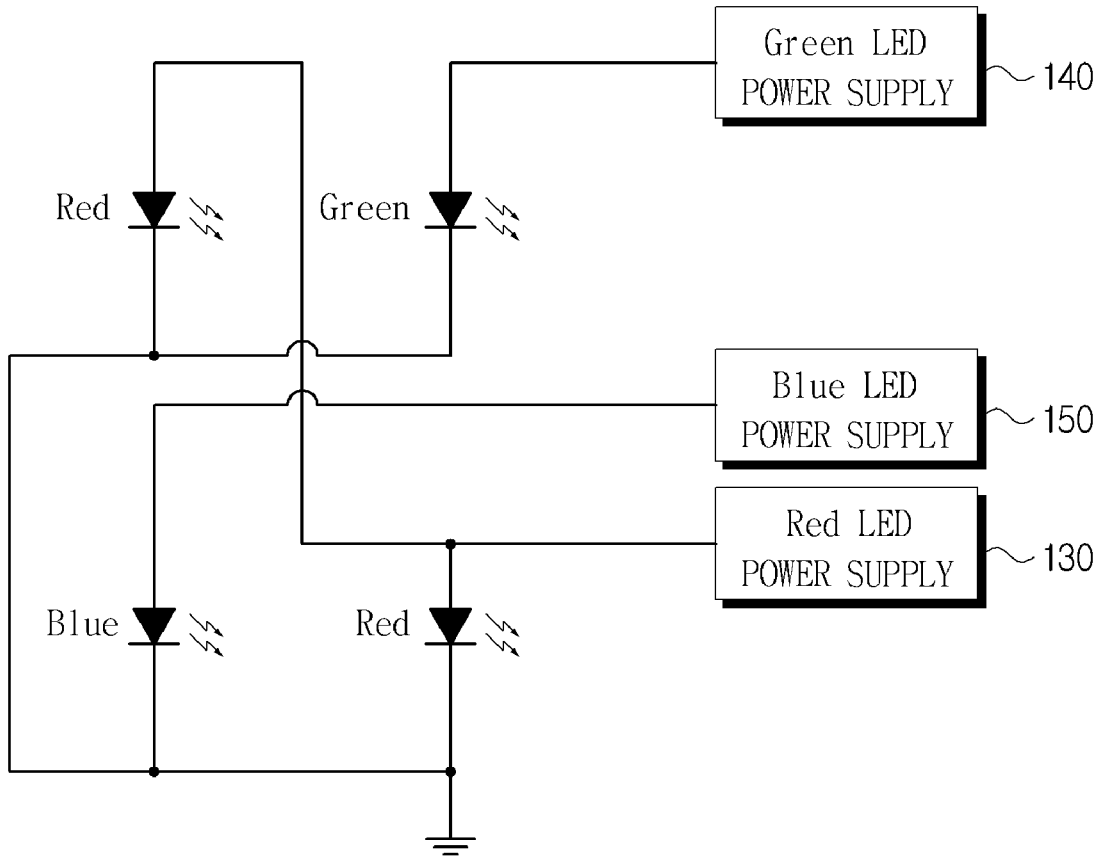
FIG. 5 illustrates a configuration view of a pixel in the power saving LED display system of FIG. 4.

FIG. 5 illustrates a configuration view of a pixel in the power saving LED display system of FIG. 4.

In order to supply an exclusive operation power to each of the LEDs, the power saving LED display system 100 includes the red LED power supply 130 for supplying the red LEDs with the red LED operation power, the green LED power supply 140 for supplying the green LED with the green LED operation power and the blue LED power supply 150 for supplying the blue LED with the blue LED operation power, as shown in FIG. 5.

Figure 2:
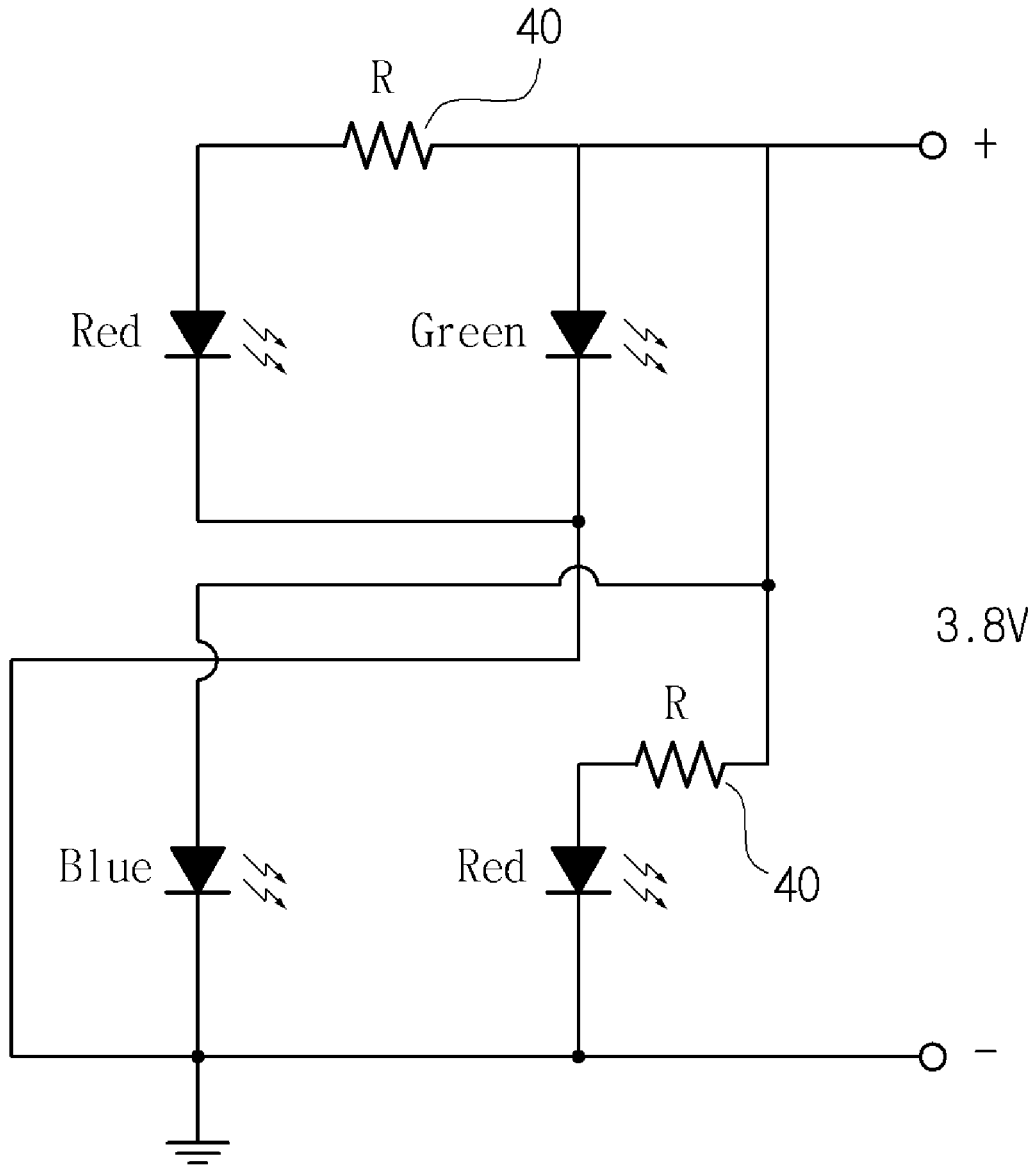
FIG. 2 PRIOR ART
FIG. 2 illustrates a configuration view of a pixel in the conventional LED light emission system of FIG. 1.

Therefore, energy waste occurring in the conventional LED light emission system during supplying the red LEDs with the input power having been subjected to voltage dropping via the voltage-dividing resistor R can be prevented (see, FIG. 2).

Figure 1:
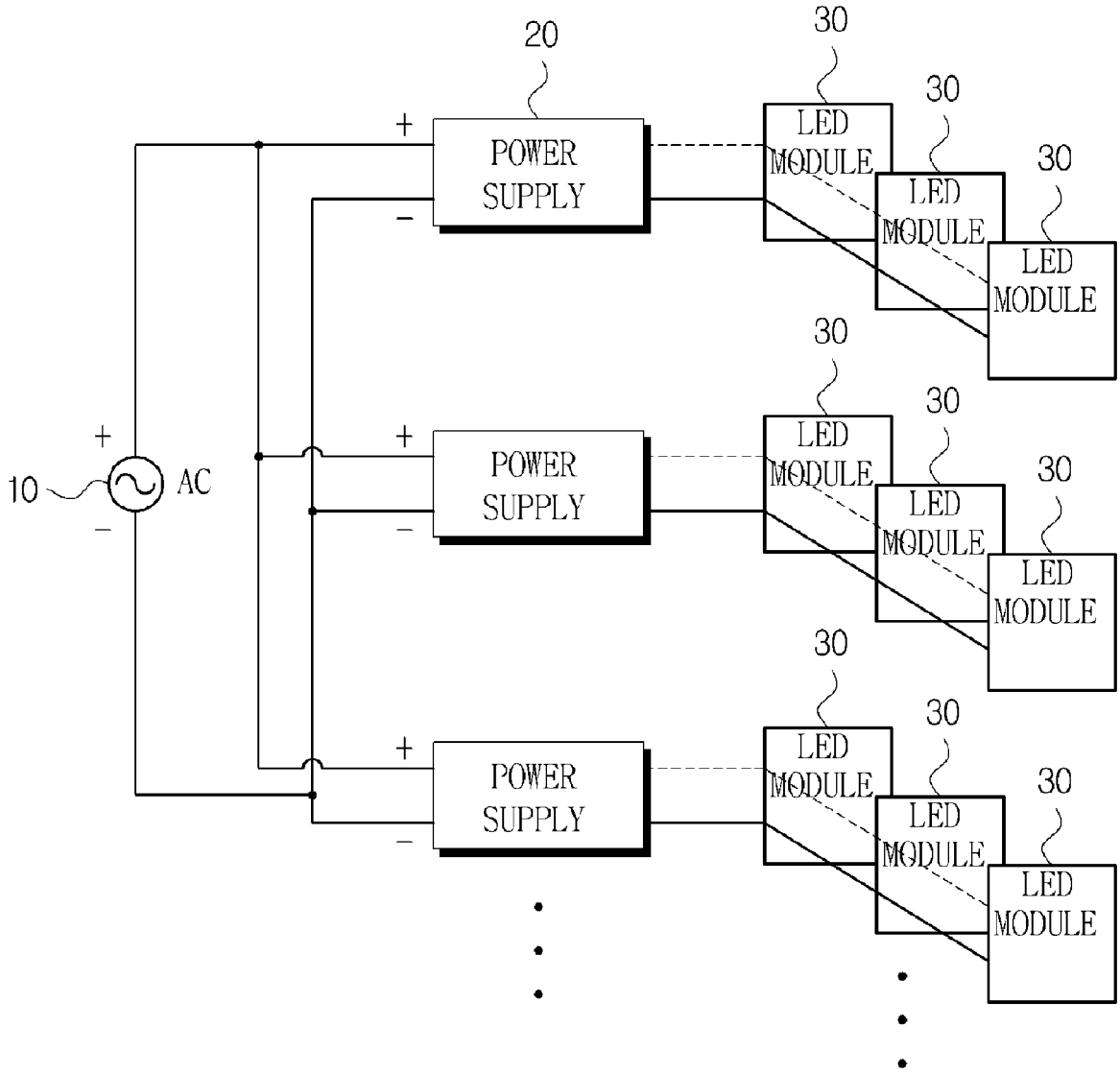
FIG. 1 PRIOR ART
FIG. 1 illustrates a conventional LED light emission system.

In the conventional LED light emission system, all the LEDs are supplied with an identical operation power of by the power supply 20 (see, FIG. 1). Thus, if a pixel is formed with four LEDs including two red LEDs, one green LED and one blue LED and 256 pixels forms one module, total power consumption becomes:

$$3.8\ V\times 0.02\ A\times 256\times 4=77.82\ W,$$

wherein an identical power of 3.8 V having a current of 0.02 A is applied to the LEDs.

However, in the power saving LED display board system 100, since a power of 1.5 V is applied to two red LEDs and a power of 3.8 V is applied to the green and the blue LED, total power consumption becomes:

$$(1.5V\times 0.02\ A\times 256\times 2)\pm(3.8V\times 0.02\ A\times 256\times 2)=46.58\ W,$$

which shows that the power saving LED display board system 100 has energy saving effect of about 40% in comparison to the conventional LED light emission system.

Meanwhile, in order to supply the red LEDs, the green LED and the blue LED with exclusive operation powers, the red LED power supply 130, the green LED power supply 140 and the blue LED power supply 150 are controlled by the DSP 170, and under the control of the DSP 170, convert the power output from the power converter 120 into respective exclusive operation powers.

In case that the DSP 170 controls the red LED power supply 130, the green LED power supply 140 and the blue LED power supply 150 in a pulse width control manner, the red LED power supply 130 is controlled to have a relatively narrow switching pulse width while the green LED power supply 140 and the blue LED power supply 150 are controlled to have a relatively wide switching pulse width. Thus, an electric power of 1.5 V is applied to the red LEDs and an electric power of 3.8 V is applied to the green and the blue LED.

Figure 6:
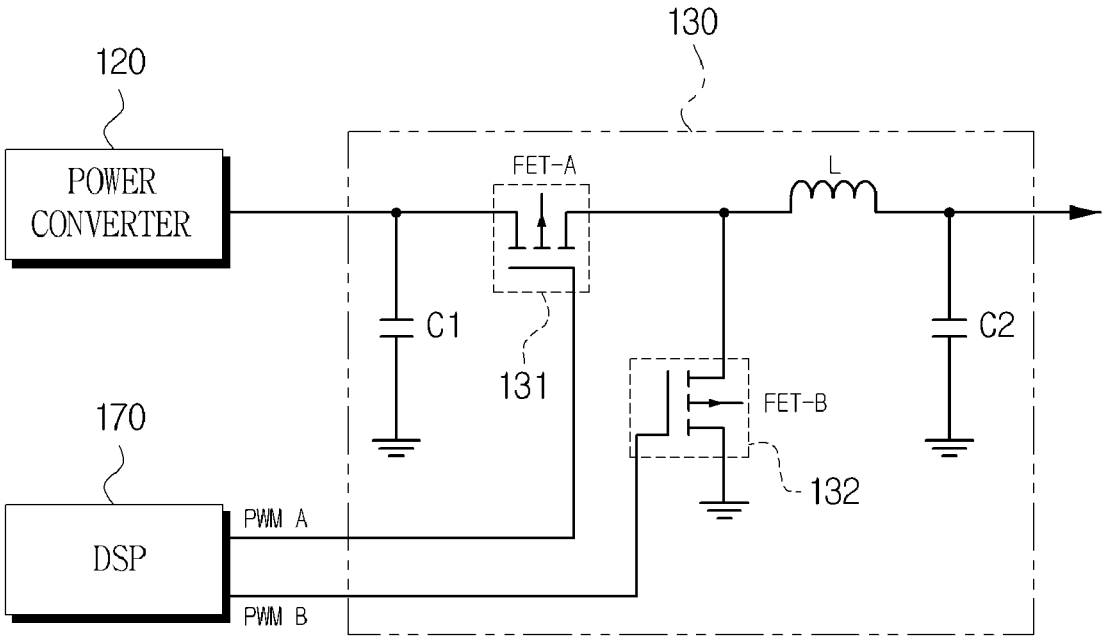
FIG. 6 illustrates an LED power supply in the power saving LED display board system of FIG. 4.

FIG. 6 illustrates the red LED power supply in the power saving LED display board system of FIG. 4.

As shown in FIG. 6, in order to convert an AC power of the secondary side of the transformer 123 into a DC power and supply thus converted DC power to the LEDs, each of the LED power supplies 130 to 150 includes a rectification circuit 131, a switching circuit 132 and smoothing circuits C1 , C2 and L.

The rectification circuit 131 and the switching circuit 132 are respectively formed with a rectification transistor FET-A and a switching transistor FET-B switching-controlled by the DSP 170. Both of the transistors FET-A and FET-B are controlled via two pulse width signals PWM A and PWM B generated by the DSP 170, the pulse width signals PWM A and PWM B being synchronized with each other.

Through the rectification transistor FET-A and the switching transistor FET-B switched simultaneously via the pulse width signals PWM A and PWM B, operation powers are supplied to the LEDs in an SMPS (Switched Mode Power Supply) manner. At this time, the operation powers are converted into DC powers the smoothing circuits C1 , C2 and L.

The rectification transistor FET-A is, for energy saving, a substitute of a conventional rectification diode, and an example of the rectification transistor FET-A may be a rectification FET.

Since the conduct voltage of the rectification FET is 0.3 V while the forward conduct voltage of a rectification diode is 0.7 V, power loss can be reduced to be a half or below. When compared to a rectification circuit using four rectification diodes, the rectification FET may show more significantly reduced power loss.

The reason for selecting the rectification transistor FET-A as the rectification circuit 131 is because the rectification transistor FET-A has a conduct voltage lower than that of the rectification diode. Thus, other transistors having a conduct voltage lower than that of the rectification diode may be used as the rectification circuit 131.

Referring back to FIG. 4, the feed-back power stabilization filters 160 feed-back output information of the LED power supplies 130 to 150 to the DSP 170. By using the fed-back output information, the DSP 170 observes power supply status of the LED power supplies 130 to 150, and based thereon adaptively controls the LED power supplies 130 to 150. The feed-back power stabilization filters 160 are disposed between the output terminals of the LED power supplies 130 to 150 and the input terminal of the DSP 170.

The power stabilization filters 160 receive output powers of the LED power supplies 130 to 150, cancel noises and unnecessary powers and then feed-back the output information to the DSP 170. Thus, the DSP 170 can perform detailed and continuous PID (Proportional-Integral-Derivative) controls on the output power of the LED power supplies 130 to 150.

As described above, in order to control overall operations of the power saving LED display board system 100 including operations of the power converter 120 and the LED power supplies 130 to 150, the DSP 170 has the PFC function to control the AC/DC converter 121, a PWM function to control the DC switch 122 and a PID function to control the LED power supplies 130 to 150.

Further, since the DSP 170 has therein the software-implemented power line communications unit (not shown), the DSP 170 can communicate with outside, e.g., a host PC (Personal Computer). Furthermore, since the power line modem interface 170*a* corresponding to communications interface of the power line communications unit is provided between the common power source 110 and the DSP 170, the DSP 170 can perform data communications via a power line.

Figure 7:
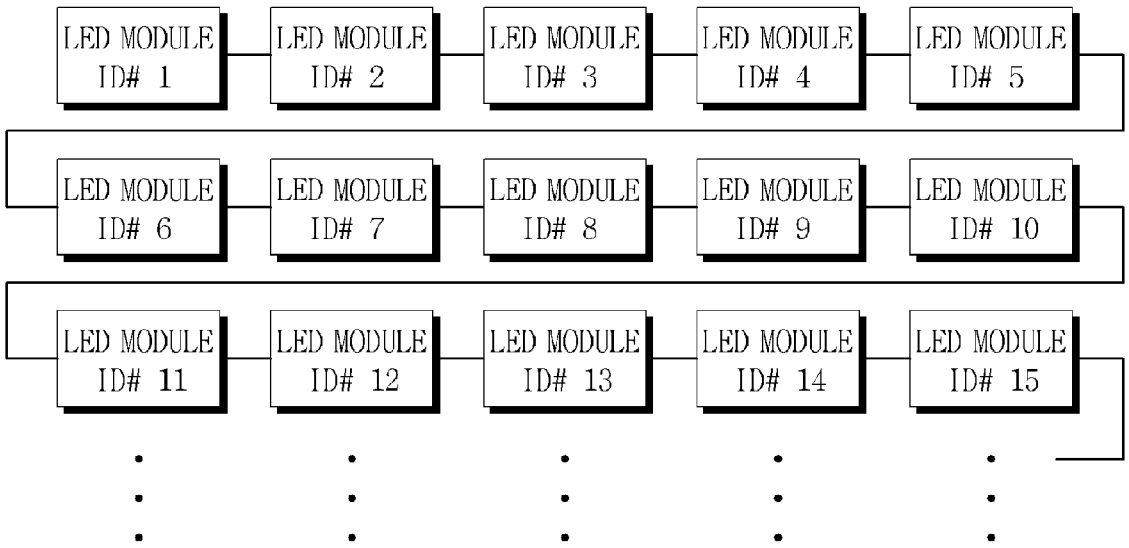
FIG. 7 illustrates LED module connectivity in the power saving LED display board system of FIG. 4.

FIG. 7 illustrates LED module connectivity in the power saving LED display board system of FIG. 4.

As shown in FIG. 7, the DSP 170 may show image data on a large display via communications with a plurality of LED modules, each LED module being assigned with a unique power line communication ID (Identification).

Figure 8:
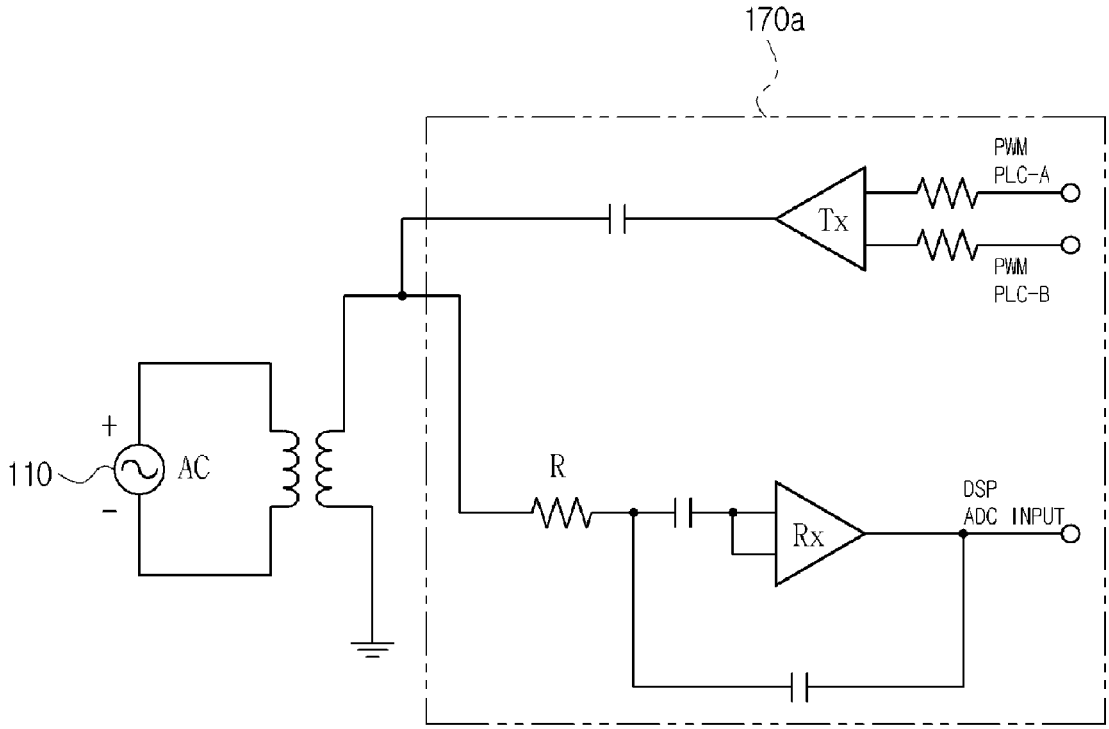
FIG. 8 illustrates a power line modem interface in the power saving LED display board system of FIG. 4.

FIG. 8 illustrates a power line modem interface in the power saving LED display board system of FIG. 4.

As shown in FIG. 8, the power line modem interface 170*a* includes a transmitter side circuit Tx and a receiver side circuit Rx. The transmitter side circuit Tx performs transmission by using the PWM function of the DSP 170, and the receiver side circuit Rx uses, e.g., an ADC (Analog Digital Converter) circuit. Since the power line modem interface 170*a* is well known, details thereof will be omitted.

Since the DSP 170 is provided with the power line modem interface 170*a*, the DSP 170 can communicate with a host PC, a sensor for sensing color temperatures of the surroundings and the like. The DSP 170 also has a white-balance adjustment function.

The DSP 170 may be provided with the color temperatures from the sensor via the power line modem interface 170*a* and can adjust white-balance based on the color temperatures of the surroundings. Accordingly, the power saving LED display board system 100 can save powers, e.g., it can lower brightness of LEDs in the night.

That is, the color temperature of the surroundings are provided to the DSP 170 via the power line modem interface 170*a*, and based thereon, the DSP 170 changes the respective operation powers of LED power supplies 130 to 150 to thereby adjust white-balance of each pixel, as is referred to "white-balance adjustment function".

Adjustment of white-balance can be performed by changing duty ratio of pulses to control the LED power supplies 130 to 150 and changing the magnitude of the powers output, based on thus changed duty ratio, from the LED power supplies 130 to 150.

Accordingly, since a host PC, for example, continuously provides image data to be displayed regardless whether it is before or after the white-balance adjustment and the white-balance adjustment is independently performed by the DSP 170, accurate and fast white-balance adjustment can be achieved.

Conventionally, original image data is converted by a host PC to reflect white-balance values to the image data and then provided to a graphic board, thereby performing white-balance adjustment. Thus, there exist drawbacks in that data loss may occur during the conversion or a product price may be increased for provision of converting modules.

Due to the above-described reasons, many conventional LED display systems do not perform white-balance adjustment, which means that the systems do not lower the brightness of LEDs in the night or in dark weather and results weak energy saving effect. However, the power saving LED display board system 100 can show strong energy saving effect by adaptively adjusting the brightness of LEDs via the white-balance adjustment based on the surroundings.

Also, it is obvious to those skilled in the art that the white-balance adjustment of the power saving LED display board system 100 can be performed by a host PC if image data loss is not taken into consideration.

Referring back to FIG. 4, the power saving LED display board system 100 may further include an LED driver 180. The LED driver 180 controls driving of pixels arranged in a grid. The LED driver 180 selects, among a plurality of pixels, pixels for use in displaying images received from the host PC and then makes only thus selected pixels emit.

That is, the LED driver 180 controls on-and-offs of switching transistors therein to supply the plurality of pixels with the operation powers supplied from the LED power supplies 130 to 150 or restrict power supply to the plurality of pixels according to the image data received from the host PC. Under the control of the LED driver 180, pixels emit selectively and according to such selective emission of the pixels, image can be displayed.

While the invention has been shown and described with respect to the embodiments, it will be understood by those skilled in the art that various changes and modification may be made without departing from the scope of the invention as defined in the following claims.

What is claimed is:

1. A power saving LED (Light Emitting Diode) display board system in which each pixel is formed by combining at least one red LED, at least one blue LED and at least one green LED, comprising:

a power converter for receiving an electric power from outside to convert the electric power;

a red LED power supply for receiving the converted electric power from the power converter to supply a red LED operation power to the red LED;

a green LED power supply for receiving the converted electric power from the power converter to supply a green LED operation power to the green LED;

a blue LED power supply for receiving the converted electric power from the power converter to supply a blue LED operation power to the blue LED; and a DSP (Digital Signal Processor) for controlling the red LED power supply to convert the electric power supplied from the power converter into the red LED operation power, controlling the green LED power supply to convert the electric power supplied from the power converter into the green LED operation power and controlling the blue LED power supply to convert the electric power supplied from the power converter into the blue LED operation power, wherein each of the red LED power supply, the green LED power supply and the blue LED power supply includes a rectification circuit for supplying corresponding LED with a DC (Direct Current) power, wherein the rectification circuit has a rectification transistor having a frequency and a pulse width controlled by the DSP; and wherein when conducting, a voltage smaller than a conduct voltage for a diode is applied to the rectification transistor.

2. The power saving LED display board system of claim 1, wherein the power converter includes:

an AC/DC (Alternating Current/Direct Current) converter for receiving an AC (Alternating Current) power from the outside to convert the AC power to a DC power;

a DC switch for receiving the DC power from the AC/DC convertor to convert the DC power into another AC power; and a transformer for receiving said another AC power from the DC switch to transform the another AC power, wherein while converting the AC power to the DC power, the AC/DC converter transforms a magnitude of the DC power into an appropriate magnitude as an input for a primary side of the transformer; and wherein the DC switch outputs said another AC power to the primary side of the transformer.

3. The power saving LED display board system of claim 2, wherein the DSP has a power factor control function to control the AC/DC converter.

4. The power saving LED display board system of claim 3, wherein the DSP has a pulse width switching modulation function to control the DC switch.

5. The power saving LED display board system of claim 1, wherein the DSP includes a power line communications unit for performing communications with outside.

6. The power saving LED display board system of claim 5, wherein the DSP has a white-balance function to adjust white-balance of the red LED, the green LED and the blue LED by controlling driving of the LEDs based on color temperatures of surroundings, the color temperatures being received via the power line communications unit.

7. The power saving LED display board system of claim 1, wherein a feed-back power stabilization filter is provided at an output terminal of each of the red LED power supply, the green LED power supply and the blue LED power supply and an output terminal of the power stabilization filter is connected to an input terminal of the DSP; and wherein the DSP observes output powers of the red LED power supply, the green LED power supply and the blue LED power supply, the output powers being received via the power stabilization filter, to control the red LED power supply, the green LED power supply and the blue LED power supply.

* * * * *